US007862708B2

(12) United States Patent
Siskin et al.

(10) Patent No.: US 7,862,708 B2
(45) Date of Patent: Jan. 4, 2011

(54) PROCESS FOR THE DESULFURIZATION OF HEAVY OILS AND BITUMENS

(75) Inventors: Michael Siskin, Westfield, NJ (US); Rustom M. Billimoria, Hellertown, PA (US); David W. Savage, Zionsville, IN (US); Roby Bearden, Jr., Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 113 days.

(21) Appl. No.: 12/287,744

(22) Filed: Oct. 14, 2008

(65) Prior Publication Data

US 2009/0152168 A1 Jun. 18, 2009

Related U.S. Application Data

(60) Provisional application No. 61/007,593, filed on Dec. 13, 2007.

(51) Int. Cl.
*C10G 45/04* (2006.01)

(52) U.S. Cl. ..... 208/229; 208/213; 208/230; 208/235; 208/250; 208/208 M

(58) Field of Classification Search ..... 208/177, 208/208 R, 209, 213, 226, 229, 230, 235, 208/250, 208 M
See application file for complete search history.

(56) References Cited

U.S. PATENT DOCUMENTS

| | | | | |
|---|---|---|---|---|
| 2,379,654 | A | 7/1945 | Royer | |
| 2,864,761 | A | 12/1958 | D'Ouville et al. | |
| 3,401,101 | A * | 9/1968 | Keller, Jr. | 205/696 |
| 3,948,754 | A | 4/1976 | McCollum et al. | |
| 3,960,708 | A * | 6/1976 | McCollum et al. | 208/121 |
| 4,003,823 | A * | 1/1977 | Baird, Jr. et al. | 208/108 |
| 4,005,005 | A | 1/1977 | McCollum et al. | |
| 4,127,470 | A * | 11/1978 | Baird et al. | 208/58 |
| 4,248,693 | A | 2/1981 | Swanson | |
| 4,437,980 | A * | 3/1984 | Heredy et al. | 208/235 |
| 4,468,316 | A | 8/1984 | Swanson | |
| 4,473,462 | A | 9/1984 | Swanson | |
| 4,564,439 | A * | 1/1986 | Kuehler et al. | 208/59 |
| 5,338,442 | A | 8/1994 | Siskin et al. | |
| 5,611,915 | A | 3/1997 | Siskin et al. | |
| 5,935,421 | A * | 8/1999 | Brons et al. | 208/226 |
| 6,294,093 | B1 | 9/2001 | Selvarajan et al. | |
| 6,887,369 | B2 * | 5/2005 | Moulton et al. | 208/107 |
| 2005/0133405 | A1 | 6/2005 | Wellington et al. | |
| 2005/0145536 | A1 | 7/2005 | Wellington et al. | |
| 2005/0155906 | A1 | 7/2005 | Wellington et al. | |
| 2007/0102323 | A1 | 5/2007 | Lee et al. | |

FOREIGN PATENT DOCUMENTS

| | | |
|---|---|---|
| BE | 888.421 | 10/1981 |
| WO | WO 99/15605 | 4/1999 |
| WO | WO 2005/061665 A2 | 7/2005 |
| WO | WO 2005/061670 A2 | 7/2005 |
| WO | WO 2005/061671 A2 | 7/2005 |
| WO | WO 2005/063936 A2 | 7/2005 |
| WO | WO 2005/066304 A2 | 7/2005 |
| WO | WO 2005/066305 A2 | 7/2005 |
| WO | WO 2005/066309 A2 | 7/2005 |

OTHER PUBLICATIONS

Claudio Bianchini, Andrea Meli; "Hydrogenation, hydrogenolysis, and hydrodesulfurization of thiophenes," Multiphase Homogeneous Catalysis (2005), vol. 1, 196-202. Abstract.

Atsushi Kishita, Satoru Takahashi, Hirotaka Kamimura, Masami Miki, Takehiko Morita, Heiji Enomoto; "Upgrading of Bitumen by Hydrothermal Visbreaking in Supercritical Water with Alkali," Regular Paper, Graduate School of Environmental Studies, Tohoku University, Sendai, Japan.

Atsushi Kishita, Satoru Takahashi, Hirotaka Kamimura, Masami Miki, Takehiko Moriya, Heiji Enomoto, "Hydrothermal Visbreaking of Bitumen in Supercritical Water with Alkali," Regular Paper, Dept. of Geoscence and Technology, Graduate School of Engineering, Tohoku University, Sendai, Japan.

Atsushi Kishita, Satoru Takahashi, Yuki Yamasaki, Fangmin Jin, Takehiko Moriya, Heiji Enomoto; "Desulfurization of Bitumen by Hydrothermal Upgrading Process in Supercritical Water with Alkali," Regular Paper, Graduate School of Environmental Studies, Tohoku University, Sendai, Japan.

Atsushi Kishita, Satoru Takahashi, Fangmin Jin, Yuki Yamasaki, Takehiko Moriya, Heiji Enomoto; "Decomposition of Benzothiophene, Dibenzothiophene, and Their Derivatives in Subcritical and Supercritical Water with Alkali," Regular Paper, Granduate School of Environmental Studies, Tohoku University, Sendai, Japan.

* cited by examiner

*Primary Examiner*—Glenn Caldarola
*Assistant Examiner*—Randy Boyer
(74) *Attorney, Agent, or Firm*—Bruce M. Bordelon

(57) ABSTRACT

The present invention relates to a process for desulfurizing bitumen and other heavy oils such as low API gravity, high viscosity crudes, tar sands bitumen, or shale oils with alkali metal compounds under conditions to promote in-situ regeneration of the alkali metal compounds. The present invention employs the use of superheated water and hydrogen under conditions to improve the desulfurization and alkali metal hydroxide regeneration kinetics at sub-critical temperatures.

9 Claims, 3 Drawing Sheets

PROCESS FOR THE DESULFURIZATION OF HEAVY OILS AND BITUMENS

This Application claims the benefit of U.S. Provisional Application No. 61/007,593 filed Dec. 13, 2007.

FIELD OF THE INVENTION

The present invention relates to a process for desulfurizing bitumen and other heavy oils such as low API gravity, high viscosity crudes, tar sands bitumen, or shale oils with alkali metal compounds under conditions to promote in-situ regeneration of the alkali metal compounds. The present invention employs the use of superheated water and hydrogen under conditions to improve the desulfurization and alkali metal hydroxide regeneration kinetics at sub-critical temperatures.

DESCRIPTION OF RELATED ART

As the demand for hydrocarbon-based fuels has increased, the need for improved processes for desulfurizing hydrocarbon feedstocks of heavier molecular weight has increased as well as the need for increasing the conversion of the heavy portions of these feedstocks into more valuable, lighter fuel products. These heavier, "challenged" feedstocks include, but are not limited to, low API gravity, high sulfur, high viscosity crudes from such areas of the world as Canada, the Middle East, Mexico, Venezuela, and Russia, as well as less conventional refinery and petrochemical feedstocks derived from such sources as tar sands bitumen, coal, and oil shale. These heavier crudes and derived crude feedstocks contain a significant amount of heavy, high molecular weight hydrocarbons. A considerable amount of the hydrocarbon of these heavy oil streams are often in the form of large multi-ring hydrocarbon molecules and/or a conglomerated association of large molecules containing a large portion of the sulfur, nitrogen and metals in the hydrocarbon stream. A significant portion of the sulfur contained in these heavy oils is in the form of heteroatoms in polycyclic aromatic molecules, comprised of sulfur compounds such as dibenzothiophenes, from which the sulfur is difficult to remove.

The high molecular weight, large multi-ring aromatic hydrocarbon molecules or associated heteroatom-containing (e.g., S, N, O) multi-ring hydrocarbon molecules in the heavy oils are generally found in a solubility class of molecules termed as asphaltenes. A significant portion of the sulfur is contained within the structure of these asphaltenes or lower molecular weight polar molecules termed as "polars" or "resins". Due to the large aromatic structures of the asphaltenes, the contained sulfur can be refractory in nature and is not very susceptible to removal by conventional alkali salt solution complexes such as potassium hydroxide or sodium hydroxide solution treatments under conventional operating conditions. Other intermediate refinery crude fractions, such as atmospheric resids, vacuum resids, and other similar intermediate feedstreams containing boiling point materials above about 850° F. (454° C.) contain similar sulfur polycyclic heteroatom complexes and are also difficult to desulfurize by conventional methods. These heavy crudes, derived refinery feedstocks, and heavy residual intermediate hydrocarbon streams can contain significant amounts of sulfur. Sulfur contents of in excess of 3 to 5 wt % are not uncommon for these streams and can often be concentrated to higher contents in the refinery heavy residual streams.

These high sulfur content hydrocarbon streams can be excessively corrosive to equipment in refinery and petrochemical production and/or exceed environmental limitations for use in processes such petroleum refining processes. If a significant amount of the sulfur is not removed from these feedstocks prior to refining, significant costs in capital equipment may be required to process these corrosive crudes and the sulfur is generally still required to be removed by subsequent processes in order to meet intermediate and final product sulfur specifications. Additionally, most conventional catalytic refining and petrochemical processes cannot be used on these heavy feedstocks and intermediates due to their use of fixed bed catalyst systems and the tendency of these heavy hydrocarbons to produce excessive coking and deactivation of the catalyst systems when in contact with such feedstreams. Also, due to the excessive hydrocarbon unsaturation and cracking of carbon-to-carbon bonds experienced in these processes, significant amounts of hydrogen are required to treat asphaltene containing feeds. The high consumption of hydrogen, which is a very costly treating agent, in these processes results in significant costs associated with the conventional catalytic hydrotreating of heavy oils for sulfur removal.

Due to their high sulfur content, high viscosities, and low API gravities, these heavy hydrocarbon feedstreams cannot be readily transported over existing pipeline systems and are often severely discounted for use as a feedstock for producing higher value products. Another alternative utilized is to make these heavy oils suitable for pipeline transportation or petrochemical feed only after significant dilution of the heavy oil with expensive, lower sulfur hydrocarbon diluents.

Therefore, there exists in the industry a need for an improved process for removing sulfur from bitumens, heavy crudes, derived crudes and refinery residual streams without requiring the use of structured catalysts or significant hydrogen consumption.

SUMMARY OF THE INVENTION

The current invention is a process for desulfurizing a sulfur-containing heavy oil feedstream to produce a product stream with a reduced sulfur content. In preferred embodiments, the viscosity of the produced product stream is reduced and the API gravity of the produced product stream is increased thereby resulting in a heavy oil product stream with improved properties for use in such applications as pipeline transportation or petroleum refining.

An embodiment of the present invention is a process for removing sulfur from a sulfur-containing heavy oil feedstream, comprising:

a) contacting a sulfur-containing heavy oil feedstream with a hydrogen-containing gas and potassium hydroxide in a superheated water solution in a reaction zone to produce a reaction effluent stream;

b) separating the reaction effluent stream into a degassed effluent stream and an overhead light gas stream; and c) conducting at least a portion of the degassed effluent stream to an initial gravity settler, thereby producing a desulfurized heavy oil product stream and an initial potassium salts solution;

wherein the reaction zone is operated at temperature from about 482° F. to about 698° F. (250 to 370° C.) and a pressure of about 600 to about 3000 psig (4,137 to 20,684 kPa) and the sulfur content of the desulfurized heavy oil product stream is at least 35 wt % lower than the sulfur content of the sulfur-containing heavy oil feedstream.

Another preferred embodiment of the present invention is a process for removing sulfur from a sulfur-containing heavy oil feedstream, comprising:

a) contacting a sulfur-containing heavy oil feedstream with a hydrogen-containing gas and potassium hydroxide in a superheated water solution in a reaction zone to produce a reaction effluent stream;

b) separating the reaction effluent stream into a degassed effluent stream and an overhead light gas stream;

c) conducting at least a portion of the degassed effluent stream to an initial gravity settler, thereby producing a desulfurized heavy oil product stream and an initial potassium salts solution; and d) conducting at least a portion of the initial potassium salts solution to a second gravity settler, wherein the second gravity settler is operated at a temperature from about 212 to about 482° F. (100 to 250° C.), thereby producing an asphaltene-rich hydrocarbon stream and a second potassium salts solution;

wherein the reaction zone is operated at temperature from about 482° F. to about 698° F. (250 to 370° C.) and a pressure of about 600 to about 3000 psig (4,137 to 20,684 kPa) and the sulfur content of the desulfurized heavy oil product stream is at least 35 wt % lower than the sulfur content of the sulfur-containing heavy oil feedstream.

Yet another preferred embodiment of the present invention is a process for removing sulfur from a sulfur-containing heavy oil feedstream, comprising:

a) contacting a sulfur-containing heavy oil feedstream with a hydrogen-containing gas and potassium hydroxide in a superheated water solution in a reaction zone to produce a reaction effluent stream;

b) separating the reaction effluent stream into a degassed effluent stream and an overhead light gas stream; and c) conducting at least a portion of the degassed effluent stream to an initial gravity settler wherein the initial gravity settler is operated at a temperature from about 212 to about 482° F. (100 to 250° C.), thereby producing an asphaltene-containing aqueous solution stream and an intermediate desulfurized heavy oil product stream;

wherein the reaction zone is operated at temperature from about 482° F. to about 698° F. (250 to 370° C.) and a pressure of about 600 to about 3000 psig (4,137 to 20,684 kPa) and the sulfur content of the intermediate desulfurized heavy oil product stream is lower than the sulfur content of the sulfur-containing heavy oil feedstream.

DETAILED DESCRIPTION OF THE INVENTION

Figure 1:
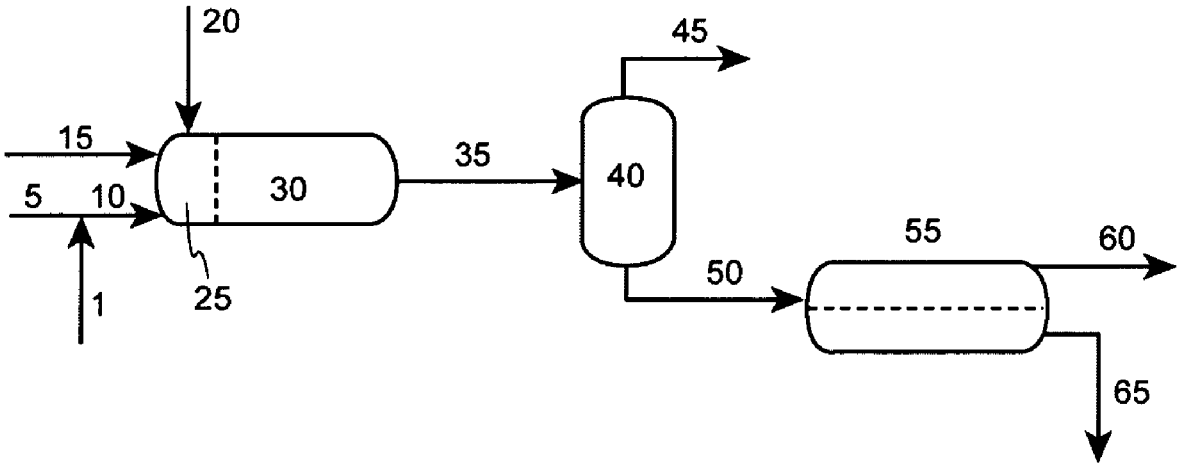
FIG. 1 illustrates one embodiment of a process scheme wherein a sulfur-containing heavy oil feedstream, superheated water, potassium hydroxide and a hydrogen-containing stream are contacted under specific conditions to produce a desulfurized heavy oil product stream with improved pipeline transport properties.

The present invention is a process for reducing sulfur content in hydrocarbon streams with in-situ regeneration of the potassium salt catalyst which may comprise potassium hydroxide, potassium sulfide, or combinations thereof. In an embodiment, the hydrocarbon feedstream to be treated contains sulfur, much of which is part of the polar fraction and higher molecular weight aromatic and polycyclic heteroatom-containing compounds, herein generally referred to as "aphaltenes" or they are associated in the emulsion phase of such asphaltene species. It should be noted here that the terms "hydrocarbon-containing stream", "hydrocarbon stream" or "hydrocarbon feedstream" as used herein are equivalent and are defined as any stream containing at least 75 wt % hydrocarbons. Another preferred embodiment of the present invention is a process for substantially separating the desulfurized hydrocarbon product stream from a stream containing the potassium salt catalyst solution, polars, asphaltenes, and PNAs; and further substantially separating the potassium salt catalyst solution from the asphaltenes and PNAs. This results in improved hydrocarbon recovery and produces an improved quality potassium salt catalyst solution stream to be treated and recycled for use in the current process.

Conventional methods of treating the heavy hydrocarbons with such compounds as alkali metal salt solutions is often not highly efficient due to the inability to obtain a high solubility level between the alkali metal salt solution and the heavy hydrocarbon. Conventionally, additional equipment and/or energy are required to increase the solubility and/or interface contact between the alkali salt-containing solution and the hydrocarbons containing the sulfur heteroatom compounds. Such methods include the use of equipment such as high shear mixers or by raising the temperature of the salt solution/hydrocarbon mixture. However, these methods often have limited success and additionally require the use of additional capital and energy costs associated with the required pumps, mixers, heaters, etc., to achieve the interface contact necessary to achieve acceptable sulfur removal rates. Also, as noted previously, heavy oil streams (less than approximately 15 API gravity and containing a substantial amount of asphaltenes and PNAs) are not well suited to conventional fixed bed catalytic hydroprocessing technologies of the art.

What has been discovered is a process wherein potassium hydroxide is utilized to desulfurize a heavy oil stream, such as, but not limited to, low API crudes (below 15 API), tar sands bitumen and shale oil, under superheated water conditions and contact with a hydrogen-containing gas stream, wherein in-situ regeneration of the potassium hydroxide solution is achieved. It has been found that very high desulfurization reaction rates can be achieved in the present invention while allowing the active potassium salt (e.g., potassium hydroxide) solution to be regenerated in-situ in the desulfurization process, especially under conditions close to, but below, the critical temperature of the water.

In the present invention, a sulfur-containing heavy oil stream, such as, but not limited to, a low API crude (i.e., below 15 API), tar sands bitumen and shale oil, or a combination thereof, is contacted with an effective amount of potassium hydroxide in the presence of superheated water and hydrogen. It is preferred if the heavy oil has a sulfur content of at least 3 wt %, even more preferably, a sulfur content of at least 4 wt %. In a preferred embodiment of the present invention, the sulfur-containing heavy oil stream is comprised of a hydrocarbon stream selected from a low API crude, a tar sands bitumen, a shale oil, and a combination thereof. FIG. 1 illustrates and further defines the process configuration and operating conditions associated with one embodiment of the present invention.

In FIG. 1, a potassium hydroxide stream (1) is added to a superheated water feedstream (5) to obtain an aqueous superheated alkali solution (10). The potassium hydroxide stream (1) will preferably be supplied in an aqueous solution from either a fresh feed mixer and/or recycled as a stream obtained from separation from the reaction products of the current process. Some or all of the fresh potassium hydroxide feed may also be supplied as a molten stream. In preferred embodiments, the superheated water temperature is about 482 to about 698° F. (250 to 370° C.), more preferably, at about 572 to about 698° F. (300 to 370° C.). As the process temperature approaches the critical temperature, the solubility of the hydrocarbons in the water phase increases significantly improving the desulfurization obtained under the present process. In preferred embodiments of the present invention, the superheated water temperature in the reaction zone is close to, but below, its critical temperature, the superheated water temperature being more preferably about 635 to about 698° F. (335 to 370° C.), and most preferably about 662 to about 698° F. (350 to 370° C.). The aqueous superheated alkali solution (10) is then fed to a mixing zone (25) in the desulfurization reactor (30).

A sulfur-containing heavy oil feedstream (15) and a hydrogen-containing feedstream (20) are also fed to the mixing zone (25). It is preferred if the mixing zone utilizes spargers, mixing baffles, and/or wetted fiber contactors to improve the contact between the sulfur-containing heavy oil feedstream (15), the superheated alkali solution (10), and the hydrogen-containing feedstream (20). It should also be noted that these three reaction streams may be combined and mixed upstream of the desulfurization reactor (30) in which case the reactor may or may not contain a mixing zone (25) as shown in FIG. 1. Herein, it should be noted that the term "sulfur-containing heavy oil feedstream" is defined as a hydrocarbon feedstock comprised of any crude oil with an API gravity of less than 15, a tar sands bitumen, an oil derived from coal or oil shale, or mixtures thereof.

Continuing with FIG. 1, it has been discovered that the current invention can be run at temperatures and pressures below the critical temperature for water while obtaining significant reductions of refractory sulfur contained in the high molecular weight heteratoms of these heavy oil feedstreams. At temperatures approaching supercritical, the solubility of the sulfur-containing heavy oil feedstream increases significantly resulting in significantly improved desulfurization reaction rates in the present invention. In contrast with the prior art supercritical processes, the potassium hydroxide in the present invention remains in solution thereby improving contact with the sulfur-containing heavy oil feedstream and significantly improving the overall sulfur conversion of the overall process.

Under the superheated conditions utilized herein, the hydrogen solubility is high enough to create a homogeneous fluid mixture in the reactor. In this process, the potassium ions break the carbon-sulfur bonds in the asphaltenes and other heteroatomic molecules to form sulfide salts. Under the highly soluble conditions of the current process, the hydrogen is available for substitution at these former sulfur sites thereby reducing the polymerization of the opened asphaltene sulfur-containing rings. The high solubility results in low amounts of excess hydrogen necessary in the current process for substitution of the broken sulfur bonds. Additionally, the high solubility of the hydrogen is effective in reducing the amount of polymerization, resulting in lower asphaltene contents and lower kinematic viscosities in the desulfurized products produced. As a result, low amounts of hydrogen as well as low hydrogen partial pressures are required for the operation of the current process. In a preferred embodiment, the desulfurization reactor (30) is operated under conditions of about 25 to about 500 psig (172 to 3,447 kPa) of hydrogen partial pressure. In more preferred embodiments, the reactor is operated under about 25 to about 250 psig (172 to 1,724 kPa) of hydrogen partial pressure, and even more preferably, the desulfurization reactor (30) can be operated under conditions of about 25 to about 100 psig (172 to 689 kPa) of hydrogen partial pressure.

These required hydrogen partial pressures are exceptionally low in comparison with the overall reactor pressures required to maintain the water under superheated conditions. In a preferred embodiment, the pressure in the desulfurization reactor (30) is from about 600 to about 3000 psig (4,137 to 20,684 kPa). More preferably, the pressure in the desulfurization reactor is from about 1250 to about 2800 psig (8,618 to 19,305 kPa), and most preferably from about 2400 to about 2600 psig (16,547 to 17,926 kPa). Reaction times will vary with the reaction temperature and can be from 10 minutes to about 5 hours, preferably from about 10 minutes to 2 hours, and more preferably, from about 10 minutes to about 1 hour.

Another benefit of the current invention is that the required partial pressure of hydrogen relative to the overall reaction pressure required can be very low. This allows the use of hydrogen-containing gas in the reaction phase with low hydrogen purities. The hydrogen purity of the hydrogen-containing gas in the reaction phase is less than 90 mol %. In certain embodiments, the hydrogen purity of the hydrogen-containing gas in the reaction phase is less than 75 mol %, and in other embodiments the hydrogen-containing gas in the reaction phase is less than 50 mol %. This can be especially beneficial where the process of the present invention is operated in the vicinity of the heavy oil production where a source of hydrogen, or especially a source of high purity hydrogen, may not be readily available. This would allow local production of higher volumes of hydrogen gas if not constrained by purity requirements or allow off-gases from related facilities with low hydrogen content to be utilized in the current process.

An unexpected benefit of running the process under the present conditions is that the chemistry favors removal of sulfur from the spent potassium hydroxide solution (or conversely from a potassium sulfide solution), thereby forming $H_2S$ and an in-situ regeneration of the potassium hydroxide in solution. The $H_2S$ can be removed in a subsequent off-gassing step, thereby eliminating or reducing the need for complicated and expensive regeneration of the potassium hydroxide solution. In the desulfurization stage of the current process the desulfurization chemistry is shown by the following simultaneous reaction equations:

$$R—S—R+2KOH+2H_2 \rightarrow 2RH+K_2S+2H_2O \quad [1]$$

$$K_2S+R—S—R+H_2 \rightarrow 2RH+2KSH \quad [2]$$

$$2R—S—R+2KOH+2H_2 \rightarrow 4RH+2KSH+2H_2O \quad [3]$$

where the symbol "R" is used herein to designate an alkyl group.

As a result, some of the KOH is converted to $K_2S$ and KSH during the desulfurization of the feed. Some of the $K_2S$ is additionally converted to KSH. The KSH is not very catalytically active in desulfurizing the hydrocarbon feeds and in prior art processes undergoes separate regeneration steps to convert the KSH back to $K_2S$ or more preferably back to KOH for re-use in the desulfurization process. However, in embodiments of the current invention, some of the converted $K_2S$ and KSH which has been utilized to desulfurize the feed can be regenerated in-situ thereby reducing and/or eliminating the need for separate, expensive potassium hydroxide regeneration processes.

In the current invention, the sulfur-containing heavy oil feedstream (15) and a hydrogen-containing feedstream (20) are contacted with the aqueous superheated alkali solution (10) under superheated water conditions. Under this process, the hydrogen is highly soluble in the aqueous alkali solution and the heavy oil feedstream allowing the following regeneration chemistry to propagate:

$$KSH + H_2O \xrightarrow{H_2} KOH + H_2S \quad [4]$$

$$K_2S + 2H_2O \xrightarrow{H_2} 2KOH + H_2S \quad [5]$$

The current process allows a portion of the sulfur to be removed from the process as hydrogen sulfide gas with little net use of hydrogen gas. The hydrogen sulfide gas produced can be easily removed by gas separation from the desulfurized feed. Additionally, in this process, the sulfur is transferred in-situ from the potassium-sulfur compounds to the generated hydrogen sulfide allowing the water chemistry to convert at least a portion of the KSH and $K_2S$ to KOH in solution. Alternatively, a portion of the KOH may be regenerated as a slip stream and may be recovered in the process and recycled for re-use in the sulfur-containing heavy oil feedstream desulfurization stage of the process.

Continuing with FIG. 1, after sufficient reaction time between the combined streams within the desulfurization reactor (30) a reaction effluent stream (35) is removed from the desulfurization reactor. In a preferred embodiment, the reaction effluent stream (35) is sent to a separator (40) wherein the light gaseous products are removed from the reaction effluent stream (35). These light gaseous products, are removed as an overhead light gas stream (45) which may contain hydrogen, hydrogen sulfide, or combinations thereof. This overhead light gas stream (45) may also contain light hydrocarbon gases including, methane, propane, and butane. It should be noted that in an alternative embodiment, the initial gravity settler (55) may be designed to allow the removal of the light gaseous products, thereby eliminating the need for the separator (40).

Continuing with FIG. 1, a degassed effluent stream (50) is sent to an initial gravity settler (55). Here the residence time through the vessel is sufficient to substantially gravity separate the desulfurized heavy oil product stream (60) from an initial aqueous potassium salts solution (65). In a preferred embodiment, the residence time of the overall volume of the entering reaction effluent stream (35) in the initial gravity settler (55) is from about 30 minutes to about 300 minutes, more preferably from about 30 minutes to about 100 minutes. In a preferred embodiment, the initial gravity settler (55) is run at a temperature and pressure in the vicinity of those of the desulfurization reactor (30). Therefore, the preferred pressure and temperature ranges described above for the desulfurization reactor (30) also apply to the initial gravity settler (55). However, lower pressures and temperatures may be employed in the initial gravity settler (55) if the reaction separator (40) is eliminated and the light gases are instead removed from the initial gravity settler (55).

In a preferred embodiment of the present invention, the desulfurized heavy oil product stream (60) has a sulfur content of at least about 35 wt % lower than the sulfur-containing heavy oil feedstream (15). However, it should be noted that in some instances only a small amount of sulfur reduction, often less than 35 wt % removal, may be desirable in order to only obtain the amount of sulfur reduction required for certain applications. However, in preferred embodiment, the present process can achieve products with sulfur contents of at least about 50 wt % lower, or even at least about 70 wt % lower than the sulfur content of the sulfur-containing heavy oil feedstream. Generally however, these high levels of sulfur removal will not be required for treating the heavy oil feedstreams noted above. In another preferred embodiment, desulfurized heavy oil product stream (60) is produced wherein the desulfurized heavy oil product stream has a sulfur content of less than 2 wt % sulfur, even more preferably, less than 1 wt % sulfur.

Another benefit thus obtained in the current process is that a desulfurized heavy oil product stream (60) can be produced which has a lower kinematic viscosity and/or higher API gravity than the sulfur-containing heavy oil feedstream (15). By utilizing the current process to highly solubize the heavy oils, potassium salt solution, and the hydrogen in the reaction process, not only is the sulfur removed from the asphaltene compounds in the heavy oils, but the polymerization of the resulting ring-opened heterocyclics and such compounds in the asphaltene fraction is significantly deterred, additionally, under the operating conditions of the initial gravity settler (55), a significant amount of the resulting asphaltenes are converted and/or separated from the desulfurized heavy oil product stream (60), resulting in significant kinematic viscosity reductions and/or a higher API gravity product.

In preferred embodiments, the desulfurized heavy oil product stream (60) obtained will have a kinematic viscosity at 212° F. (100° C.) that is at least about 25% lower than the kinematic viscosity at 212° F. (100° C.) of the sulfur-containing heavy oil feedstream (15). Preferably, the kinematic viscosity at 212° F. (100° C.) of desulfurized heavy oil product stream obtained will be at least about 50% lower, or even more preferably at least about 75% lower, than the kinematic viscosity at 212° F. (100° C.) of the sulfur-containing heavy oil feedstream. Similarly, in preferred embodiments, the desulfurized heavy oil product stream (60) obtained will have an API gravity at least about 5 points higher than the API gravity of the sulfur-containing heavy oil feedstream (15). In more preferred embodiments, the desulfurized heavy oil product stream obtained will have an API gravity at least about 10 points higher than the API gravity of the sulfur-containing heavy oil feedstream.

It should be noted that "desulfurized heavy oil product stream" produced by embodiments of the process configuration as described below for FIG. 2 and the "final desulfurized heavy oil product stream" produced by embodiments of the process configuration as described below for FIG. 3 can achieve the improved product properties for sulfur reduction, kinematic viscosity reduction, and/or API gravity increase relative to the sulfur-containing heavy oil feedstream as described for the process configuration associated with FIG. 1 above.

Figure 2:
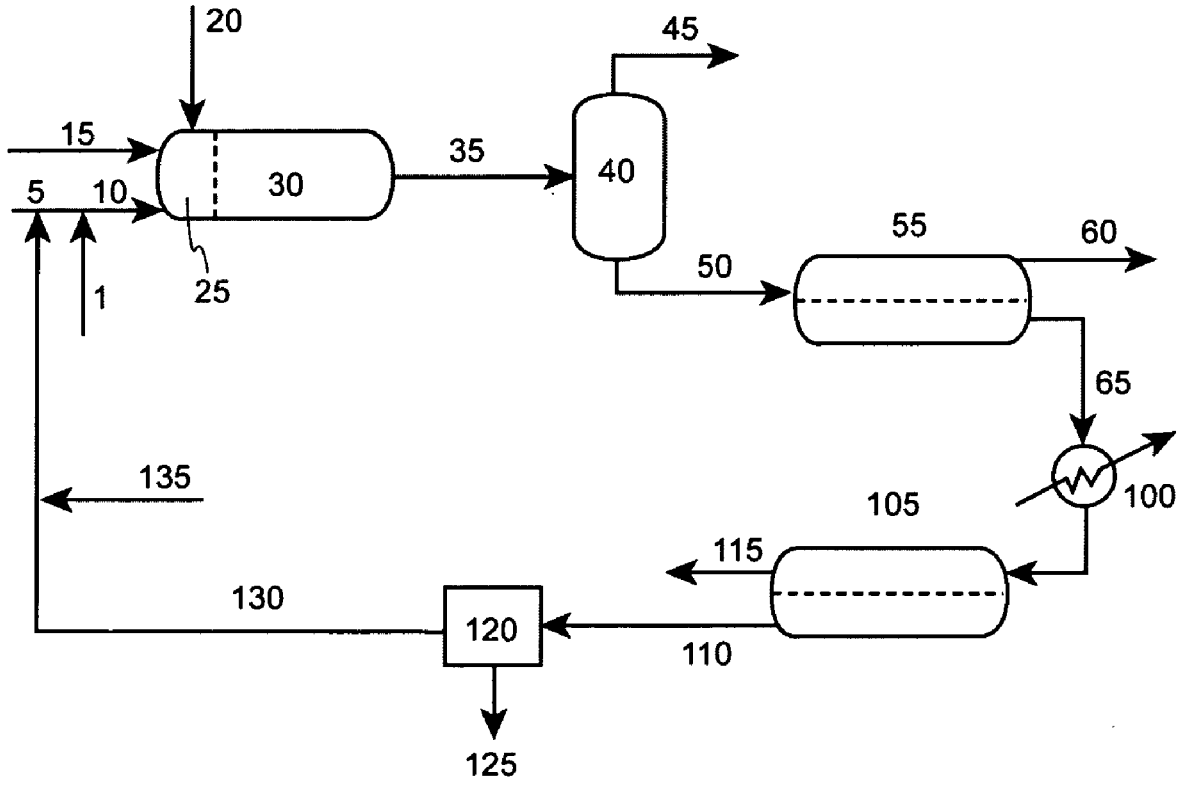
FIG. 2 illustrates one embodiment of a process scheme wherein a sulfur-containing heavy oil feedstream, superheated water, potassium hydroxide and a hydrogen-containing stream are contacted under specific conditions to produce a desulfurized heavy oil product stream with improved pipeline transport properties and a segregated desulfurized asphaltene stream.

FIG. 2 shows another embodiment of the present invention wherein a second gravity settler is utilized and the second gravity settler is operated at a lower temperature and lower pressure than the initial gravity settler to improve the removal of asphaltenes and polynuclear aromatics ("PNAs") from the initial aqueous potassium salts solution obtained from the initial gravity settler. This embodiment also includes a process for purging some of the potassium reaction compounds and providing a KOH recycle stream for use in the process.

In describing the embodiment of FIG. 2, elements (1) through (65) provide the same function and operating parameters as in the embodiment described by FIG. 1. However, returning to the embodiment of FIG. 2, it has been found that the solubility of the asphaltenes and PNAs (alternatively termed simply as "asphaltenes" herein) at the temperature and pressure operating conditions of the initial gravity settler (55) is still significant and a substantial portion of these compounds may be carried through the gravity settler with the water phase materials. While it may be beneficial that these somewhat undesirable components of the stream are removed from desulfurized heavy oil product stream (60) produced, these highly soluble asphaltenes can be problematic in later salts and entrained metals removal steps by fouling separations equipment and exceeding aromatic hydrocarbon contents on disposed removed solids. Additionally, these asphaltenes may be difficult to remove in subsequent solution recycle or KOH salts regeneration processes, resulting in these unwanted compounds being recycled for reuse in the desulfurization process.

Therefore, in an embodiment of the current invention as illustrated in FIG. 2, the initial aqueous potassium salts solution (65), which may contain a significant portion of the asphaltenes from the initial feedstream, is sent to a cooler (100) to reduce the temperature of the aqueous potassium salts solution (65) prior to sending the solution to a second gravity settler (105). In a preferred embodiment, the second gravity settler (105) is operated at a temperature from about 212 to about 482° F. (100 to 250° C.), more preferably from about 302 to about 437° F. (150 to 225° C.). It is preferred if the operating pressure of the second gravity settler (105) is sufficient to maintain the water contained in the process stream in the liquid phase. Although the second gravity settler (105) can operate at pressures as high as those described for the initial gravity settler described in this embodiment, the preferred operating pressure ranges for the second gravity separator are from about 50 to about 600 psig (345 to 4,137 kPa), more preferably from about 100 to about 400 psig (689 to 2,758 kPa). At these reduced temperatures, the solubility of the asphaltenes decreases significantly and forms a liquid-to-liquid separate phase with a second aqueous potassium salts solution stream (110) which is drawn off of the second gravity settler (105). This stream has a lower asphaltene content than the initial aqueous potassium salts solution (65) obtained from the initial gravity settler. An asphaltene-rich hydrocarbon stream (115) can then be drawn off the top phase of the second gravity settler (105).

The second aqueous potassium salts solution stream (110) is sufficiently reduced in hydrocarbon content to send the stream to a solids separation unit (120) for removal of spent salts, such as KSH, from the process. The solids separation unit (120) can utilize filtering, gravity settling, or centrifuging technology or any technology available in the art to separate a portion of the spent and/or insoluble potassium salt compounds (125) to produce low-sulfur recycle stream (130). The solids separation unit (120) can utilize the same technology to also remove feed-derived metal sulfide and metal oxide compounds present in the second aqueous potassium salts solution stream (110).

After appropriate heating and repressurization, the low-sulfur recycle stream (130) thus produced can be reintroduced into the superheated water feedstream (5) thereby reducing the water makeup and/or contaminated water disposal requirements of the current process. Optionally, an additional potassium hydroxide make-up stream (135) may be mixed with the low-sulfur recycle stream (130) providing alternative methods for supplying and controlling the necessary potassium hydroxide content to the desulfurization reactor (30).

Figure 3:
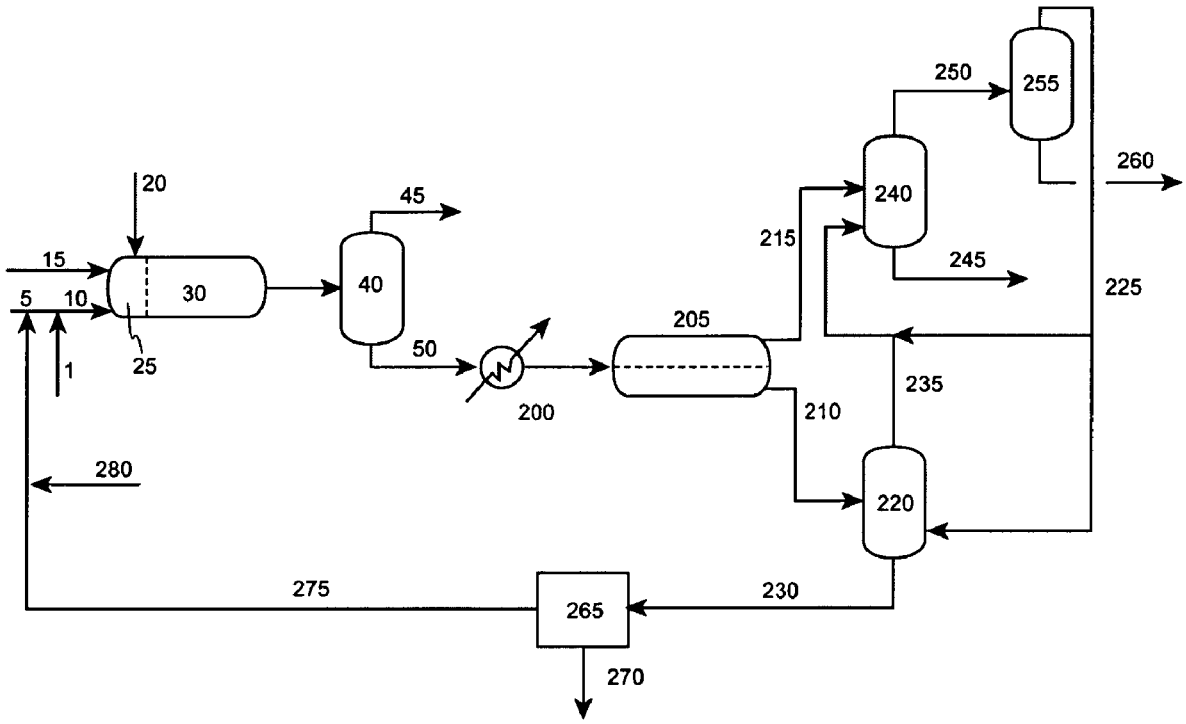
FIG. 3 illustrates one embodiment of a process scheme wherein a sulfur-containing heavy oil feedstream, superheated water, potassium hydroxide and a hydrogen-containing stream are contacted under specific conditions to produce a desulfurized heavy oil product stream with improved pipeline transport properties and a segregated desulfurized asphaltene stream wherein the process results in improved asphaltene removal from the desulfurized heavy oil product stream and improved desulfurized asphaltene recovery.

In yet another embodiment of the present invention, the process configuration shown in FIG. 3 illustrates the desulfurization process of the present invention wherein the asphaltenes and PNAs (i.e., "asphaltenes") are further separated from the desulfurized heavy oil product stream obtained from the initial gravity separator.

In FIG. 3, elements (1) through (50) provide the same function and operating parameters as in the embodiment described by FIG. 1. However in the embodiment shown in FIG. 3, the degassed effluent stream (50) is sent to a cooler (200) prior to being sent to an initial gravity settler (205). Here, the degassed effluent stream (50) is sent through a cooler (200) to allow the initial gravity settler (205) in this embodiment to be operated at lower temperatures than the initial gravity settlers discussed in the prior embodiments. In the embodiment, the initial gravity settler is operated at a temperature from about 212 to about 482° F. (100 to 250° C.), more preferably from about 302 to about 437° F. (150 to 225° C.). It is preferred if the operating pressure of the initial gravity settler (205) is sufficient to maintain the water contained in the process stream in the liquid phase. Although the initial gravity settler (205) can operate at pressures as high as those described for the desulfurization reactor described of this embodiment, the preferred operating pressure ranges for the second gravity separator are from about 50 to about 600 psig: (345 to 4,137 kPa), more preferably from about 100 to about 400 psig (689 to 2,758 kPa). At these reduced temperatures, the solubility of the asphaltenes decreases significantly and a portion of the asphaltenes in the degassed effluent stream (50) will precipitate out in the initial gravity settler (205) and be drawn off with the aqueous phase components from the lower portion of the initial gravity settler (205) in the form of an asphaltene-containing aqueous solution stream (210). An intermediate desulfurized heavy oil product stream (215) with reduced sulfur content and asphaltene content is drawn from the upper portion of the initial gravity settler (205).

The asphaltene-containing aqueous solution stream (210) contains a portion of the hydrocarbon emulsions which are formed in the process between the high molecular weight aromatic asphaltenes, water, and solids in the process stream. This asphaltene-containing aqueous solution stream (210) is sent to an emulsion breaker vessel (220) for separation of the asphaltene and polynuclear aromatic (herein termed simply as "asphaltene") compounds from water/salts/solids phase of the emulsion. In the emulsion breaker vessel (220) a paraffin-enriched stream (225) is introduced which reduces the solubility for the polynuclear aromatic asphaltene compounds in the emulsion phase of the asphaltene-containing aqueous solution stream (210), but can strip other desirable paraffinic and low molecular weight hydrocarbons for recovery. In this step, the high solids content, high molecular weight oils as well as solids and metals from the emulsion phase can be removed with the aqueous phase of the process in the emulsion breaker bottoms stream (230). It is preferred that the paraffin-enriched stream (225) have a significant content of $C_6$ to $C_8$ paraffins. Readily available intermediate product streams from related processes, such as naphthas, may be used in the paraffin-enriched stream (225).

It is preferred that the paraffin enriched stream (225) enter the emulsion breaker vessel (220) in the lower portion of the vessel such that the lighter paraffin enriched stream flows upward through the emulsion breaker vessel (220), while the high solids content, high molecular weight oils as well as a high content of the solids and metals and water from the emulsion phase gravitates to the lower portion of the vessel. It is also desirable to have increased contact area configurations in the emulsion breaker vessel (220), that have high flow areas and are resistant to fouling. In a preferred embodiment, shed trays are employed in the emulsion breaker vessel (220).

Continuing with FIG. 3, an emulsion breaker overhead stream (235) is drawn from the emulsion breaker vessel (220) and sent to a precipitation vessel (240). Some of the paraffin enriched stream (225) may optionally be added to the emulsion breaker overhead stream (235) to increase the paraffin content of the stream prior to entering the precipitation vessel (240). In this embodiment, it is preferred that the emulsion breaker overhead stream (235) enter the lower portion of the precipitation vessel (240) creating an upflow of the emulsion breaker overhead components through the precipitation vessel. In the precipitation vessel, increased paraffin content of the emulsion breaker overhead stream (235) lowers the solubility of the asphaltenes in the intermediate desulfurized heavy oil product stream (215) which is introduced into the precipitation vessel. As a result, the intermediate desulfurized heavy oil product stream is further reduced in asphaltene content in the precipitation vessel (240) and a precipitator overhead stream (250) is drawn from the precipitation vessel.

Similar to the emulsion breaker vessel (220) it is desired that the precipitation vessel (240) have increased contact area configurations with high flow areas and are resistant to fouling. In a preferred embodiment, shed trays are employed in the precipitation vessel (240). This high efficiency process for separating the asphaltenes from the desulfurized heavy oil product process also further desulfurizes the heavy oil product stream as most of the unreacted refractory sulfur compounds remaining in the hydrocarbons are drawn off with the asphaltene-enriched product stream (245). An additional benefit is that the viscosity of the precipitator overhead stream thus produced is lower in viscosity than the intermediate desulfurized heavy oil product stream (215).

The precipitator overhead stream (250) produced is sent to a paraffin recovery tower (255) wherein a portion of the lighter molecular paraffinic components are separated from the precipitator overhead stream (250) to produce the paraffin enriched stream (225) discussed previously. A final desulfurized heavy oil product stream (260) is drawn from the paraffin recovery tower (255). This final desulfurized heavy oil product stream has a lower sulfur wt % content, lower kinematic viscosity, higher API gravity, and lower asphaltene content as compared to the sulfur-containing heavy oil feedstream (15) that is utilized as a feedstream to this embodiment of the present invention.

In particular, this embodiment of the present invention not only removes a significant portion of the sulfur and asphaltenes present in the sulfur-containing heavy oil feedstream (15), but also segregates a significant portion of the asphaltenes that are undesired in the final desulfurized heavy oil product stream (260) so that these hydrocarbons may be utilized in associated processes such as a heating fuel for associated process streams or in the production of asphalt grade materials. It should also be noted that these asphaltenes obtained from the present embodiment are also lower in sulfur content than if they had been segregated from the sulfur-containing heavy oil feedstream (15) without being subjected to the current desulfurization process. This is especially beneficial for meeting environmental specifications if the asphaltene-enriched product stream (245) is utilized as a heating fuel.

Continuing with the embodiment of the present invention as illustrated FIG. 3, the emulsion breaker bottoms stream (230) is sufficiently reduced in soluble or entrained hydrocarbons to send the stream to a solids separation unit (265) for removal of spent salts from the process, such as $K_2S$ and KHS, as well as insoluble KOH salts unreacted in the desulfurization process. The solids may also contain precipitated asphaltenes from the emulsion breaking step which may be filtered from the stream. The solids separation unit (265) can utilize filtering, gravity settling, or centrifuging technology or any technology available in the art to separate a portion of the spent and/or insoluble potassium salt compounds (270) to produce low-sulfur recycle stream (275). The solids separation unit (265) can utilize the same technology to also remove metal sulfide and metal oxide compounds as well as asphaltene precipitates and other particulates present in the emulsion breaker bottoms stream (230).

After appropriate heating and repressurization, the low-sulfur recycle stream (275) thus produced can be reintroduced into the superheated water feedstream (5) thereby reducing the water makeup and/or contaminated water disposal requirements of the current process. Optionally, an additional potassium hydroxide make-up stream (280) may be mixed with the low-sulfur recycle stream (275) providing alternative methods for supplying and controlling the necessary potassium hydroxide content to the desulfurization reactor (30).

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A process for removing sulfur from a sulfur-containing heavy oil feedstream, comprising:

a) contacting a sulfur-containing heavy oil feedstream with a hydrogen-containing gas and potassium hydroxide in a superheated water solution in a reaction zone to produce a reaction effluent stream;

b) separating the reaction effluent stream into a degassed effluent stream and an overhead light gas stream;

c) conducting at least a portion of the degassed effluent stream to an initial gravity settler wherein the initial gravity settler is operated at a temperature from about 212 to about 482° F. (100 to 250° C.), thereby producing an asphaltene-containing aqueous solution stream and an intermediate desulfurized heavy oil product stream; and d) contacting at least a portion of the asphaltene-containing aqueous solution stream with a paraffin enriched stream containing $C_6$ to $C_8$ paraffins, and gravity separating the mixture to produce an emulsion breaker bottoms stream and an emulsion breaker overhead stream wherein the emulsion breaker overhead stream contains at least a portion of the asphaltenes and $C_6$ to $C_8$ paraffins from the mixture;

wherein the reaction zone is operated at temperature from about 482° F. to about 698° F. (250 to 370° C.) and a pressure of about 600 to about 3000 psig (4,137 to 20,684 kPa) and the sulfur content of the intermediate desulfurized heavy oil product stream is lower than the sulfur content of the sulfur-containing heavy oil feedstream.

2. The process of claim 1, wherein the hydrogen partial pressure in the reaction zone is from about 25 to about 500 psig (172 to 3,447 kPa) and the contact reaction time in step a) of the process is from about 10 minutes to about 5 hours.

3. The process of claim 2, further comprising:

contacting at least a portion of the emulsion breaker overhead stream with at least a portion of the intermediate desulfurized heavy oil product stream, and gravity separating the mixture to produce a precipitator overhead stream and an asphaltene-enriched product stream; and separating at least a portion of the precipitator overhead stream into the paraffin enriched stream and a final desulfurized heavy oil product stream;

wherein the sulfur content of the final desulfurized heavy oil product stream is at least 35 wt % lower than the sulfur content of the sulfur-containing heavy oil feedstream.

4. The process of claim 3, wherein the kinematic viscosity at 212° F. (100° C.) of the final desulfurized heavy oil product stream is at least about 25% lower than the kinematic viscosity at 212° F. (100° C.) of the sulfur-containing heavy oil feedstream and the API gravity of the final desulfurized heavy oil product stream is at least 5 points greater than the API gravity of the sulfur-containing heavy oil feedstream.

5. The process of claim 4, wherein the sulfur-containing heavy oil feedstream is comprised of a stream selected from a crude oil with an API gravity of less than 15, a tar sands bitumen, an oil derived from coal, an oil derived from oil shale, and mixtures thereof.

6. The process of claim 5, further comprising:

conducting at least a portion of the emulsion breaker bottoms stream to a solids separator wherein at least a portion of the spent potassium salt compounds and metal compounds contained in the emulsion breaker bottoms stream are removed therefrom, producing a low-sulfur recycle stream; and conducting at least a portion of the low-sulfur recycle stream to the reaction zone of the process.

7. The process of claim 5, wherein the reaction zone is operated at temperature from about 635° F. to about 698° F. (335 to 370° C.) and a pressure of about 1250 to about 2800 psig (8,618 to 19,305 kPa).

8. The process of claim 7, wherein the sulfur content of the sulfur-containing heavy oil feedstream is at least about 3 wt % and the sulfur content of final desulfurized heavy oil product stream is less than about 2 wt %.

9. The process of claim 8, wherein the reaction zone is operated at temperature from about 662° F. to about 698° F. (350 to 370° C.).

* * * * *